United States Patent [19]

Forslin

[11] Patent Number: 4,686,805

[45] Date of Patent: Aug. 18, 1987

[54] PANEL SUPPORT

[75] Inventor: Gary L. Forslin, Johnson City, Tenn.

[73] Assignee: Jarl Extrusions, Inc., Elizabethton, Tenn.

[21] Appl. No.: 703,993

[22] Filed: Feb. 21, 1985

[51] Int. Cl.[4] ..... E06B 3/00

[52] U.S. Cl. ..... 52/208; 52/731; 52/204; 49/DIG. 1

[58] Field of Search ..... 52/204, 208, 213, 475, 52/731, 732; 49/DIG. 1

[56] References Cited

U.S. PATENT DOCUMENTS

| | | | |
|---|---|---|---|
| 3,055,468 | 9/1962 | Horejs et al. | 52/731 X |
| 3,340,663 | 9/1967 | Collard | 52/204 X |
| 3,769,775 | 11/1973 | Brzezinsi | 52/731 |
| 4,064,653 | 12/1977 | Randall et al. | 49/DIG. 1 X |
| 4,275,526 | 6/1981 | Abramson | 49/DIG. 1 X |
| 4,292,771 | 10/1981 | Ellis | 52/213 X |
| 4,344,254 | 8/1982 | Varlonga | 49/DIG. 1 X |
| 4,420,919 | 12/1983 | Weber | 52/204 |
| 4,455,800 | 6/1984 | Hosooka et al. | 52/731 X |

FOREIGN PATENT DOCUMENTS

| | | | |
|---|---|---|---|
| 0053196 | 6/1982 | European Pat. Off. | 52/204 |

*Primary Examiner*—William F. Pate, III
*Assistant Examiner*—Creighton Smith

[57] ABSTRACT

A panel support for various kinds of panels such as windows sliding doors, room dividers or the like, comprising sash means having wall means adapted to be spaced outwardly from and substantially encircling the periphery of panel means, shoulder means adapted to contact and retain said panel means in position within said sash means with said wall means in spaced relationship to said panel means periphery, the width of said wall means adapted to extend generally perpendicular to the plane of said panel means and for a distance at least substantially the thickness thereof, primary thermal break means in said wall means extending substantially the length thereof, mounting means for securing said sash means to a building, and shroud means adapted to lie adjacent portions of either one or both edges of said wall and mounting means and having surfaces spaced from said portions to provide dead-air, secondary thermal break means.

32 Claims, 7 Drawing Figures

PANEL SUPPORT

The present invention concerns a novel and improved panel support particularly useful in prefabricated and preassembled form for rapid and easy installation wherever an enclosure is desired. More particularly the invention concerns a panel support having unique characteristics including improved thermal insulating qualities and improved structure greatly simplifying its assembly into the aforesaid prefabricated form. This support is especially useful for supporting panels of any material including glass, plastic, metal, wood, fiber board, or the like and of any configuration and utility such as for windows, doors, roof and ceiling sections of transparent materials such as glass or plastic, or for exterior or interior walls for rooms or other enclosures. Of special importance, the present support has particular utility for use in multiple windowed rooms in new building construction or for addition to existing structures, which rooms consist primarily of thermally insulated windows including bow and bay types and often comprising multiple windows separated by mullions. Exemplary of such rooms are sun spaces and typical ones are as shown in the accompanying drawings.

One of the most important requirements of such panel support structure is that it possess good thermal barrier properties since, for example, in a typical sun space, a major area of the exposed surfaces constitutes window units. While providing good insulation properties in window or other panel support structure which is of a permanent nature may be a relatively easy matter, considerable insulating problems arise where the support is prefabricated and preassembled and is then installed in a preexisting building, especially where the panel support is metallic.

Objects therefore of the present invention are: to provide a panel support, particularly a window support, which can be prefabricated to provide improved, readily assembleable sections; to provide these sections with improved snap fastening means for assembling the same; and to provide such support with markedly improved thermal barrier means.

These and other objects hereinafter appearing have been attained in accordance with the present invention through the panel support structure which, in its broad embodiment, comprises sash means having wall means adapted to be spaced outwardly from and substantially encircling the periphery of panel means, shoulder means adapted to contact and retain said panel means in position within said sash means with said wall means in spaced relationship to said panel means periphery, the width of said wall means adapted to extend generally perpendicular to the plane of said panel means and for a distance at least substantially the thickness thereof, primary thermal break means in said wall means extending substantially the length thereof, mounting means for securing said sash means to a building, and shroud means adapted to lie adjacent portions of either one or both edges of said wall and mounting means and having surfaces spaced from said portions to provide dead-air, secondary thermal break means.

In a most preferred embodiment, hereinafter described in detail, the aforesaid sash means, mounting means (such as a frame), and shroud means are provided with cooperating snap-fastening means which allows easy and rapid interconnection thereof, requiring a minimum of time, technical skill and effort.

In accordance with another aspect of the present invention it has been found that a surprisingly large improvement in thermal insulation for the panel support is achieved by providing the aforesaid primary thermal break means in those sections of the sash and mounting means which constitute walls, in combination with secondary thermal break means provided by shroud means surrounding either or both of the interior or exterior surfaces of the support and spaced therefrom to provide insulative dead-air spaces. This combination is particularly useful in conjunction with the aforesaid snap-fastening feature but may be used also with conventional fabricated window sash and frame construction.

Further objects and advantages of the present invention will become apparent from the following description and drawings wherein.

Figure 1:
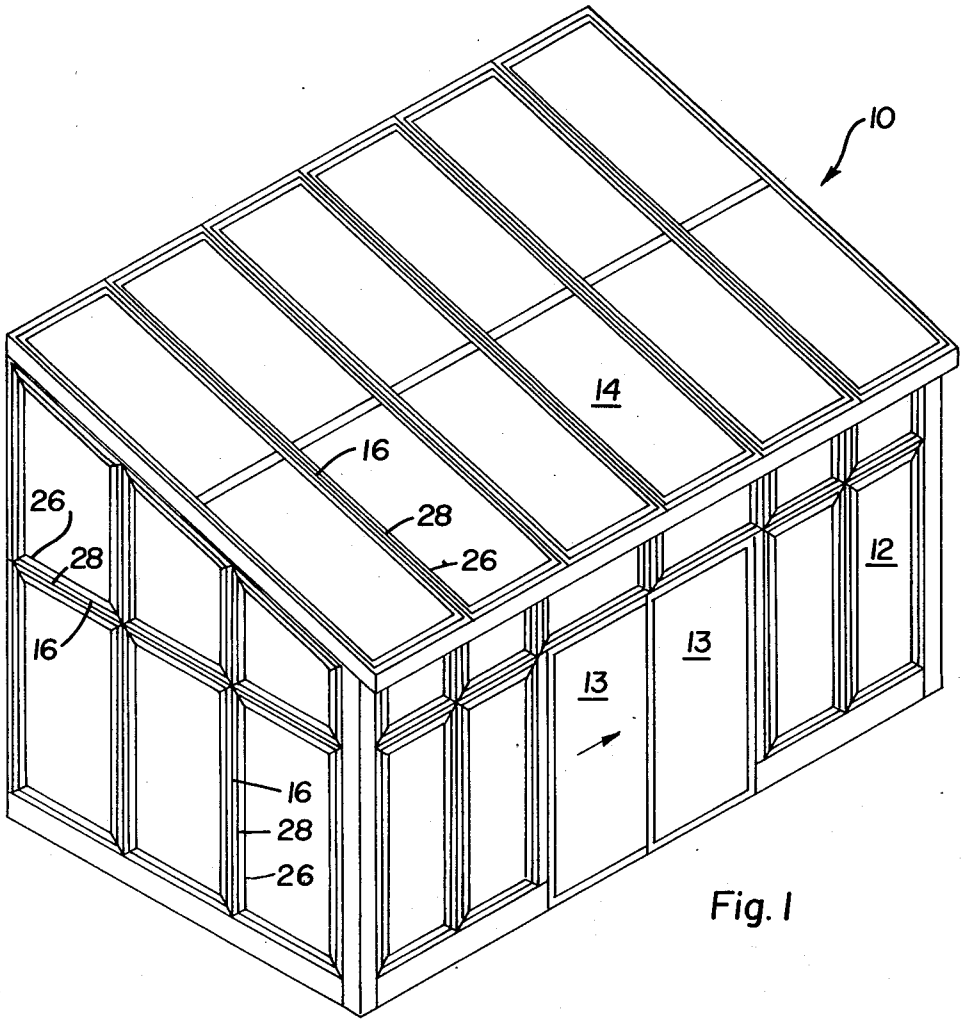
FIG. 1 is an isometric, elevational view of a typical sun space embodying the present invention
Figure 6:
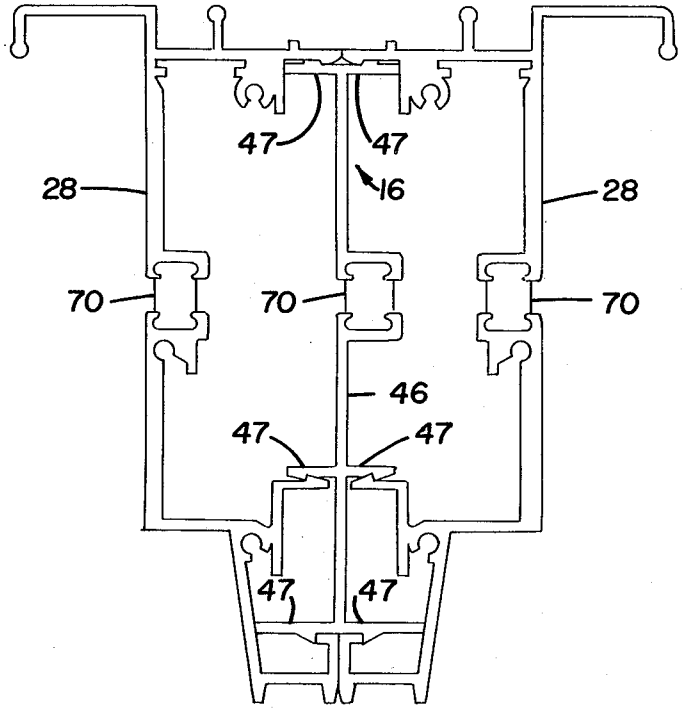
FIG. 6 is an isolated cross-sectional view of a planar oriented frame and mullion arrangement.
Figure 3:
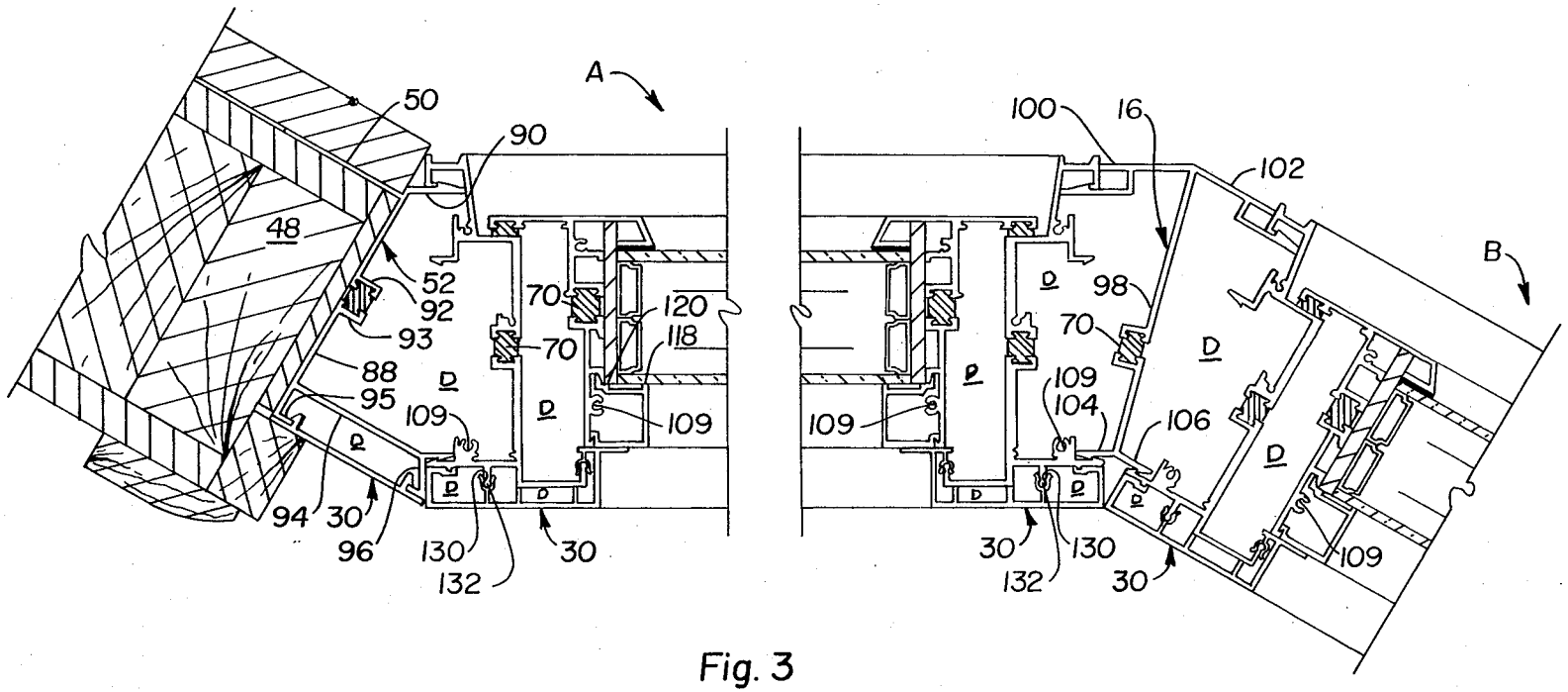
FIG. 3 is a cross-sectional view of another embodiment of the support including a lesser angled mullion and adaptor means for fastening the support to a building.

Referring to the drawings, FIGS. 1 and 6, show typical sun spaces generally designated, 10 for which the present invention is particularly useful. The sun spaces are shown to be comprised essentially of wall window panels 12, sliding doors 13, and roof panels 14 which may be solid or transparent windows or lights. These panels, in the embodiment shown, employ the construction which utilizes the mullion component 16 in accordance with the present invention, greater detail of which is shown in FIG. 3 for angled window use. The present snap fastening means, hereinafter described in detail, may also be built into the panel support and other components of the sun space to allow very rapid assembly of the entire sun space by unskilled labor.

Figure 2:
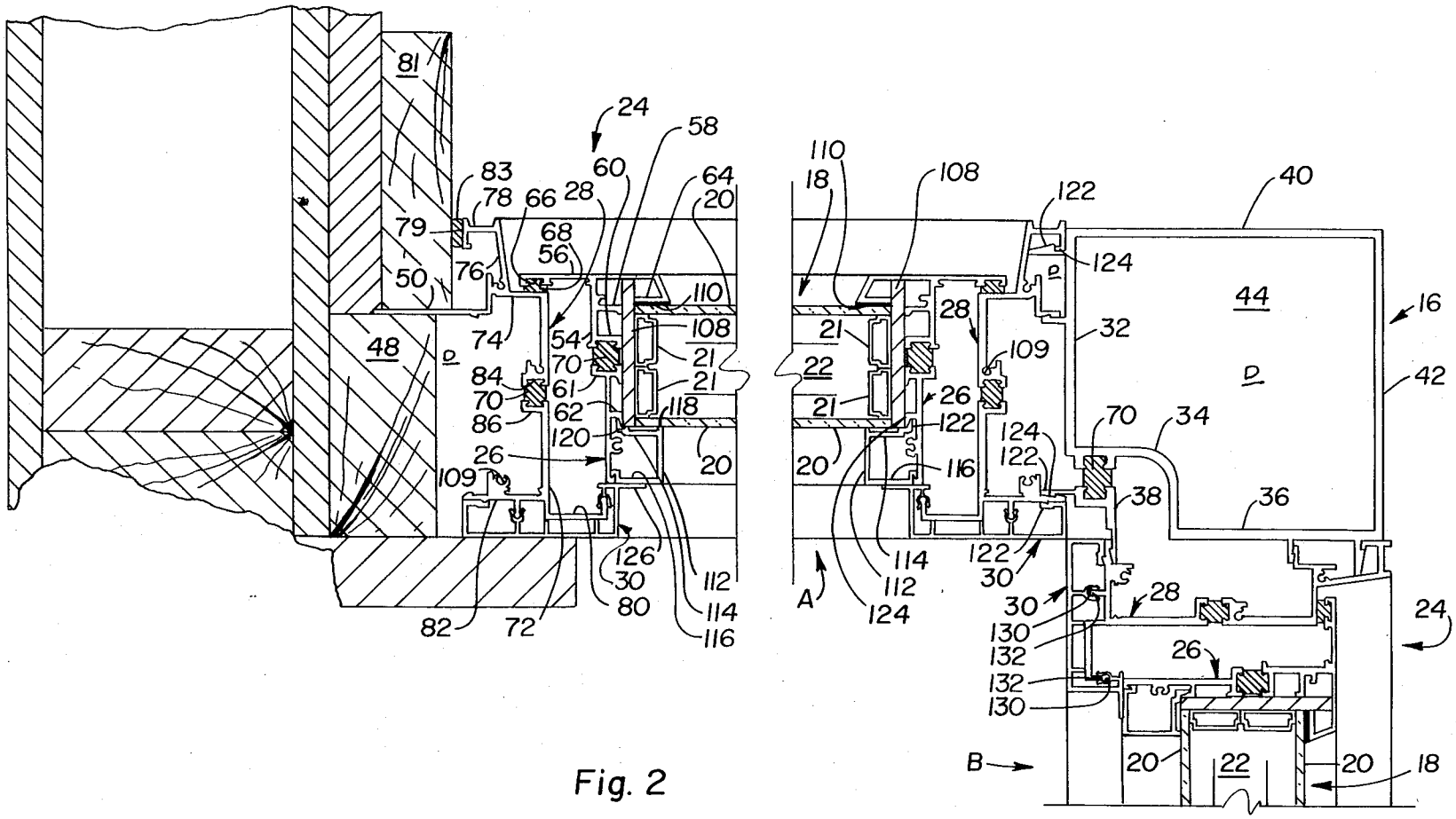
FIG. 2 is a cross-sectional view of one embodiment of the present panel support including a right angle mullion post and adjacent building.

Referring to FIG. 2, the present panel support is shown in an exemplary cross-sectional view of a vertical portion of two window units A & B, and adjacent structural members of a building such as a sun space. Each window unit comprises a thermally insulated window panel generally designated 18 which is of any type construction including for example, double, tri or quad panes 20 (commonly termed "glazing") separated and supported by members 21 providing a dead-air space 22, said panel 18 being contained in the panel support of the present invention generally designated 24. In this embodiment the support generally comprises sash means 26, mounting means in the form of a frame 28, and shroud means 30. In this embodiment, the window units A & B are non-planar oriented and are separated at their adjacent sides by mullion means generally designated 16 comprising partition means consisting of wall segments 32, 34, 36 and 38 which can be formed integrally with exterior wall segments 40 and 42 to provide a unitary corner mullion post 44 for the building. By comparison, in FIG. 6, the frames 28 of adjacent window units are shown as planar oriented and employ a symmetrically shaped mullion 16 which is more simple in construction and comprises essentially, partition means or main wall 46 and leg means 47.

The other sides of the above described window units A & B are attached to structural members or portions of the building, such as stud 48. This is readily accomplished in accordance with one embodiment of the present invention by providing installation means in the form of a flange 50 or the like on frame 28. This flange preferably formed integrally on the frame during the extrusion thereof, can be provided, if necessary, with nail or screw holes for fastening the same securely to stud 48. This attachment of frame 28 to the building stud is the counterpart of the attachment of the other side of frame 28 to the mullion 16. As an alternative or supplement to flange 50, adaptor means such as 52 may be provided as shown in FIG. 3 as a plate which may be connected by screws or nails or the like to stud 48 and having snap fastening means for receiving and locking frame 28 to the stud, all of which are described in greater detail below.

Referring in more detail to FIG. 2, sash means 26, preferably of extruded aluminum and typically of the dimensional proportions shown, comprises wall means 54 and depending segments 56, 58, 60, 61, and 62. Segment 56 is formed at one end to provide an inwardly or reverse directed portion or stop means 64 for holding the window panel 18 in place as described below, and at its other end to provide a slot 66 for holding a weather seal 68 of any sealing material such as butyl or silicone rubber or the like. Segments 60 and 61 provide opposed grooves for securely holding primary thermal break means comprising thermal insulating material 70 which is typically composed of ridged, cured, foamed polyurethane, acrylic, epoxy, polyester or the like synthetic material and which is sufficiently strong to maintain integrity of sash 26, whether the window is installed in a permanently closed position or is openable as in casement and awning windows. The installation of the window panel 18 in sash 26 and the interconnections thereof with frame 28 and mullion means 16 or adaptor means 52 will be described in detail below. Frame 28, also preferably of extruded aluminum, comprises web (wall) means 72 and depending segments 74, 76, 78, 80, 82, 84, and 86. Segments 84 and 86 provide the opposed grooves for permanent attachment to the aforesaid insulating material 70 providing primary thermal break means.

Shown in FIG. 3 is adaptor means 52, also preferably of extruded aluminum comprising plate means 88 and depending segments 90, 92, 93, 94, 95, and 96 with segments 92 and 93 providing the opposed grooves for permanent attachment to primary thermal break means comprising the aforesaid insulating material 70 segments 90 and 94 are shown to provide spanner means for retaining web 72 and plate 88 in spaced relationship. In FIG. 3, the window units A and B are shown in non-planar arrangement and the numbering of the structural elements thereof are the same as that of similar elements of the structure shown in FIG. 2 even though the actual shape or configuration of these elements are somewhat different, the essential aspects thereof being equivalent. In this embodiment, the mullion 16 is given a symmetrical configuration similar to that shown in FIG. 6 and comprises the partition means 98 and angled depending segments or leg means 100, 102, 104, and 106. Partition means 98 and also its equivalent structure, wall segment 38 of mullion post 16 of FIG. 2, are provided with primary thermal break means comprised of the aforesaid insulating material 70 in the manner shown for the sash and frame.

The following description of the assembly of the present panel support and its mounting in and connection to the structure of a building and further detailed description of the shroud means and its function, will demonstrate the extensive allowable variation in shape and configuration of the various support elements. In this description, it must be understood that these various elements of the present invention such as the frame, sash, mullion, shroud, and adaptor usually completely surround the panel periphery, regardless of the configuration thereof. For example, where the panel is rectangular the aforesaid elements are preferably cut at 45 degree angles at the corners to provide for essentially a continuum of the primary thermal breaks and other structure such as the secondary thermal breaks provided by the shroud 30, and of the dead air spaces designated D, throughout the entire 360 degree periphery of the support elements.

Figure 5:
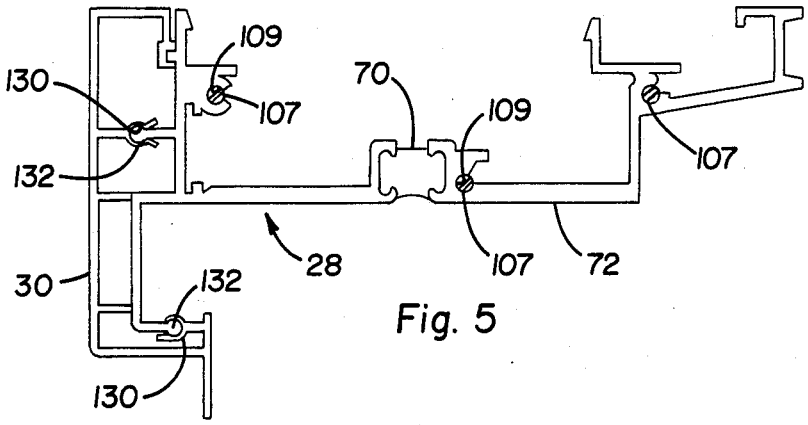
FIG. 5 is a 45 degree angled end of an end piece of the frame showing the screws of FIG. 4 is cross-section.
Figure 4:
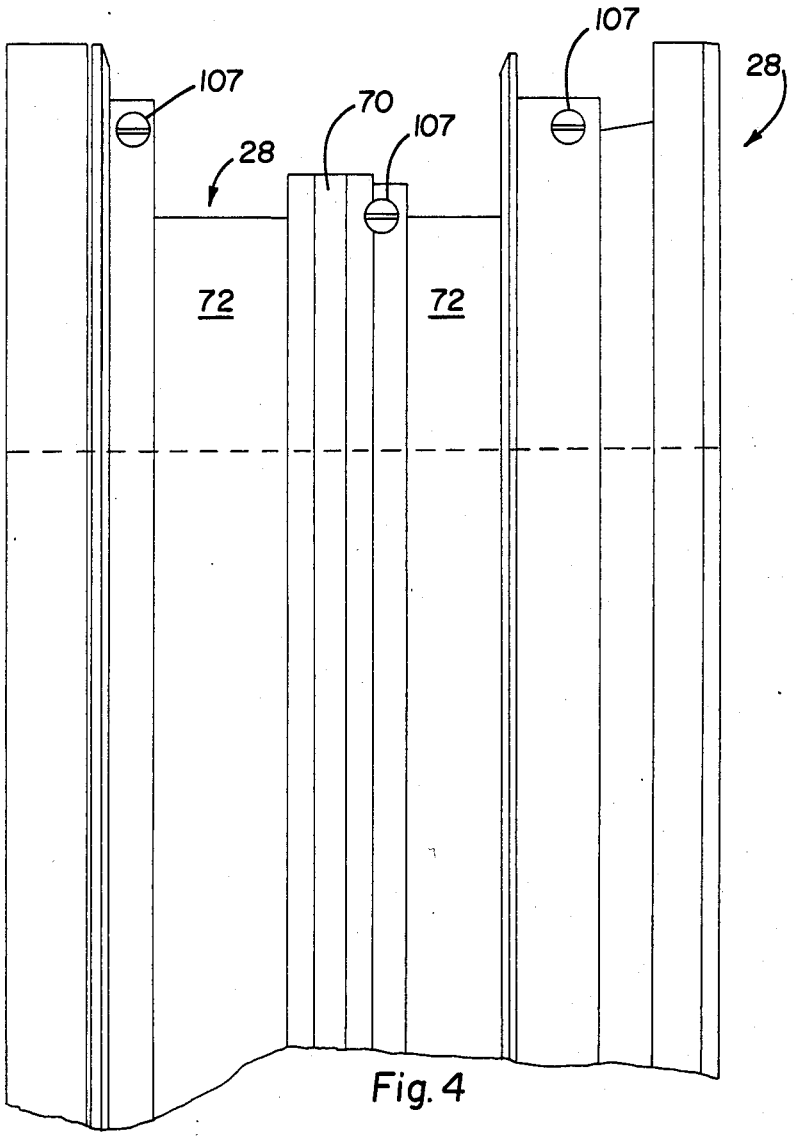
FIG. 4 is an elevational view of a side piece of the frame showing the position of the screws for connecting the same to an end piece.

In the assembly of the present panel support, panel 18 (rectangular for this description) is set into sash 26 (rectangular) comprised of the sides as shown in cross-section in FIG. 2, and identically shaped top and bottom pieces. The sides are secured to the top and bottom pieces by screws such as 107 as shown in FIGS. 4 and 5 threaded into slots 109 which are of any convenient configuration and are preferably formed integrally with the sash pieces during extrusion thereof. Cushioning and sealing material 108 and 110 are provided to reduce the chances of damage to the panel while sealing the same within the sash against both air and moisture. With the panel positioned in the sash abutting said cushioning material 108 and 110, glazing bead 112 in the form of a plastic strip such as vinyl is snapped into place, locking the panel tightly against the said cushioning material and peripheral portions of the panel sides. This is accomplished by providing said glazing bead with opposing sides or segments 114 and 116 which can be flexed toward each other to engage cooperating snap fastening shoulders 122 and 124 on the sash and bead respectively. The said peripheral side portions of the panel are thus compressed between the glazing bead side 114 which contacts the panel by its ridge means 118 and the opposing stop provided by segment 64 of the sash and the adjacent sealing material 110 thereon. Side 116 of the glazing bead provides the counter force for urging side 114 toward the panel surface. The type of snap fastening means comprising interlocking shoulders 122 and 124 which may vary in configuration, is used repeatedly in the present panel support and numbered the same herein. These interlocking shoulders should extend at least a major portion of the length of each piece in the assembly to maximize the overall strength thereof. It is noted that glazing bead 112 is a separate element but forms part of the overall shroud means 30 and contributes in a very important way to the formation of the most preferred form of secondary thermal break provided thereby.

This panel-sash assembly is then assembled into the frame with the seal 68 and glazing bead side 116 bearing against shroud segment 126 attached to the frame as shown in FIG. 2. The frame and adaptor 52, if employed, are previously assembled to the building as shown in FIGS. 2 and 3. The snap-fastening means employed on the frame are essentially the same as for the sash and its shroud, except that where lateral movement might disengage the shoulders, a more positive locking means comprising expansible slot member 130 and projection 132 is employed. In the embodiment of FIG. 2 the segment 78 on the exterior portion of the frame is shown provided with a flange 79 which lies adjacent a trim piece 81 of the building such that caulking material 83 may be forced therebetween to further thermally and weather seal the window unit to the building. Thermal insulation may be placed in any of the cavities as desired to further enhance the thermal barrier properties of the window assembly.

The sash and supported window panel as shown in FIGS. 2 and 3, are of the openable type wherein the sash is hinged in some manner to the frame as in conventional awning or casement type windows. Any of the typical hinging and locking mechanisms for such windows can be employed in the present invention and detailed disclosures thereof are not necessary here. Suffice it to say that such mechanisms are shown, for example, in the July, 1983, product catalogue of TRUTH Incorporated, 700 West Bridge Street, Owatonna, MN.

Figure 7:
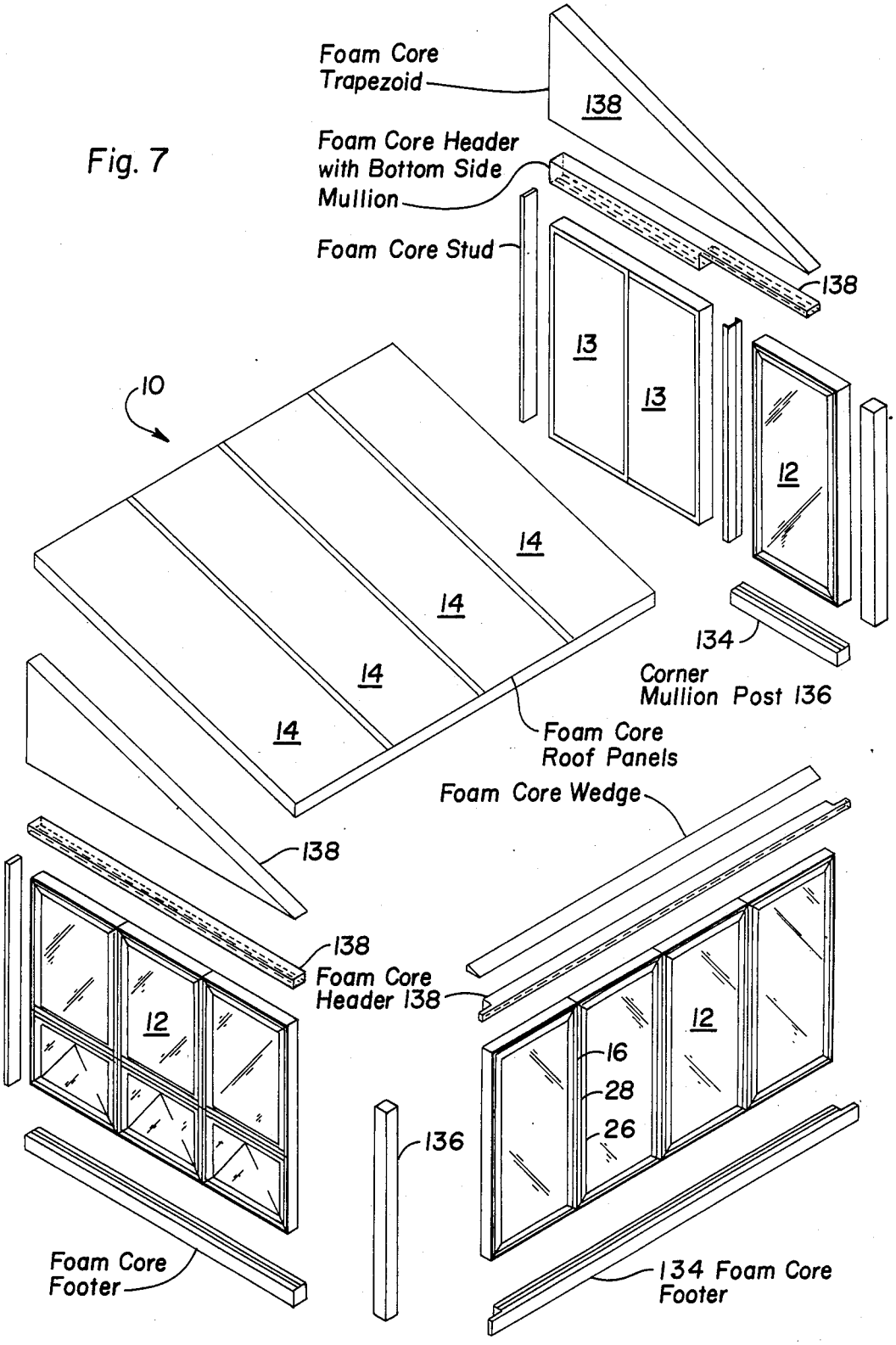
FIG. 7 is an exploded, isometric view of a sun space such as shown in FIG. 1, embodying the present invention.

Referring to FIGS. 1 and 7, the same elements thereof are numbered the same as in FIGS. 2–5. In FIG. 1 the roof panels are shown as windows or lights and in FIG. 7 as foam core construction which, of course, can still employ the sash, frame, mullion and shroud arrangement of the present invention, if so desired. In FIGS. 1 and 7, the sill, end and header pieces, 134, 136, and 138 respectively, may be of any convenient construction and material, but in the context of a completely prefabricated and readily assembleable room or sun space construction, are preferably of insulating material such as foamed polyurethane or the like. These pieces also may be provided with snap fastening means as shown herein, or may, of course, be assembleable by conventional means such as screws, or the like.

The invention has been described in detail with particular reference to preferred embodiments thereof, but it will be understood that veriations and modifications can be effected within the spirit and scope of the invention.

I claim:

1. A panel support comprising sash means having wall means adapted to be spaced outwardly from and substantially encircling the periphery of panel means, shoulder means adapted to contact and retain said panel means in position within said sash means with said wall means in spaced relationship to said panel means periphery, the width of said wall means adapted to extend generally perpendicular to the plane of said panel means and for a distance at least substantially the thickness thereof, primary thermal break means in said wall means extending substantially the length thereof, mounting means for securing said sash means to a building, shroud means adapted to lie adjacent portions of either one or both edges of said wall means and mounting means and having surfaces spaced from said portions to provide dead-air, secondary thermal break means, and a glazing bead forming part of said shroud means and adapted to retain said panel in position.

2. The support of claim 1 wherein said mounting means is adapted to position and maintain said wall means in spaced relationship to said building.

3. The support of claim 2 wherein said mounting means comprises a frame having web means adapted to be spaced outwardly from and substantially encircling the periphery of said wall means, and spacer means adapted to retain said sash component within said frame with said wall and web means in spaced relationship.

4. The support of claim 3 wherein primary thermal break means is provided in said web means extending substantially the length thereof.

5. The support of claim 4 wherein said shroud means is adapted to lie also adjacent portions of either or both edges of said web means and having surfaces spaced from said portions of said web means to provide additional dead-air, secondary thermal break means.

6. The support of claim 5 wherein said mounting means includes installation means for securing the same to a building.

7. The support of claim 6 wherein said installation means comprises a flange on said frame substantially encircling the periphery thereof.

8. The support of claim 6 wherein said installation means comprises adaptor means having plate means adapted to be secured to a building, said plate means being adapted to be spaced outwardly from and substantially encircling the periphery of said web means, and spanner means adapted to retain said web and plate means in spaced relationship.

9. The support of claim 8 wherein primary thermal break means is provided in said plate means extending substantially the length thereof.

10. The support of claim 9 therein said shroud means is adapted to lie also adjacent portions of either or both edges of said plate means and having surfaces spaced from said portions of said plate means to provide additional dead-air, secondary thermal break means.

11. The support of claim 1 wherein said glazing bead is adapted to flex and bear against said panel means.

12. The support of claim 11 wherein said glazing bead is a separate element of said shroud means and is adapted to be assembled and disassembled on said sash means independently of the other elements of said shroud means.

13. The support of claim 12 wherein said glazing bead has a generally three sided, cross-sectional configuration with two generally opposing and spaced sides which are adapted to be flexed toward each other for assembly to said sash means.

14. The support of claim 13 wherein contact ridge means are provided on said glazing bead and adapted to bear against a peripheral side portion of said panel means, and stop means on said sash means spaced from said ridge means and adapted to bear against a substantially directly opposite peripheral side portion of said panel means to provide a mounting seat there-between for said panel means whereby said glazing bead in combination with said stop means can provide a clamping force on said opposed peripheral side portions of said panel means.

15. The support of claim 14 wherein said contact ridge means and adjacent portions of said shroud means are adapted, in combination with said panel means, to provide a dead-air space substantially surrounding one of said peripheral side portions of said panel means.

16. The support of claim 1 wherein said shroud means is spaced from said wall and/or mounting means by divider means which provides said secondary thermal break means with a plurality of separated, dead-air chambers.

17. The support of claim 12 wherein said sash means, glazing bead, and panel means are adapted to move as a unit relative to said mounting means and the other elements of said shroud means.

18. The support of claim 17 wherein hinge means are provided to interconnect said sash means and said mounting means for allowing said relative movement.

19. The support of claim 18 wherein cooperating sealing means are provided on said sash means and said mounting means.

20. The structure of claim 1 wherein mullion means are provided intermediate two or more panel supports for interconnecting the same to provide multiple, adjacent, panel units.

21. The structure of claim 20 wherein said mullion means comprises partition means having leg means extending from each side thereof for spacing the same from each adjacent panel support.

22. The structure of claim 21 wherein primary thermal break means are provided in said partition means extending substantially the length thereof.

23. The structure of claim 22 wherein said shroud means extends substantially unbroken from one panel means to an adjacent mullion to another adjacent panel means.

24. The support of claim 1 wherein said shroud means is adapted to extend substantially unbroken from said panel means to an adjacent building.

25. The support of claim 1 having panel means mounted therein comprising one or a combination of material selected from glass, plastic, metal or cellulosic.

26. The support of claim 25 wherein said panel means is of thermal pane construction.

27. The structure of any one of claims 1 or 20 mounted in a building.

28. The structure of claim 27 wherein said building is a sun space.

29. The structure of claim 28 having panel means mounted therein comprising one or a combination of material selected from glass, plastic, metal or cellulosic.

30. The structure of claim 20 wherein said supports are of rectangular configuration and mullion means are mounted on at least two sides of one mounting means and at least one side of at least two adjacent mounting means.

31. The structure of claim 30 wherein mullion means are provided substantially surrounding the peripheries of the mounting means of multiple adjacent panel supports.

32. The structure of any one of claims 1–10, 11–15, or 16, wherein cooperating snap-fastening means are provided on two or more of the structural elements comprising the sash means, shroud means, mounting means, frame, installation means, glazing bead, or adaptor means, for connecting these elements together in interlocking manner.

* * * * *